US005167071A

United States Patent [19]

Eisen

[11] Patent Number: 5,167,071

[45] Date of Patent: Dec. 1, 1992

[54] COSMETIC PENCIL SHARPENER

[75] Inventor: Johann C. Eisen, Baiersdorf, Fed. Rep. of Germany

[73] Assignee: Cosmolab, Inc., Lewisburg, Tenn.

[21] Appl. No.: 821,853

[22] Filed: Jan. 14, 1992

Related U.S. Application Data

[63] Continuation of Ser. No. 578,184, Sep. 6, 1990, abandoned.

[30] Foreign Application Priority Data

Jan. 3, 1990 [DE] Fed. Rep. of Germany ..... 4000122

[51] Int. Cl.[5] ..... B43L 23/08

[52] U.S. Cl. ..... 30/452; 30/453; 30/457

[58] Field of Search ..... D19/73; 144/28.1, 28.11, 144/28.2, 28.3, 28.4, 28.5, 28.6, 28.7, 28.72, 28.71, 28.8, 28.9; 30/451, 452, 453, 454, 455, 456, 457, 458, 459, 460, 461, 462

[56] References Cited

U.S. PATENT DOCUMENTS

| | | | |
|---|---|---|---|
| D. 226,403 | 2/1973 | Rosson | D19/73 |
| D. 251,977 | 5/1979 | Leuenberger et al. | D19/73 |
| D. 254,858 | 4/1980 | Mobius | D19/73 |
| D. 255,127 | 5/1980 | Mobius | D19/73 |
| 359,026 | 3/1887 | McKinnon | 30/457 X |
| 362,669 | 5/1887 | Schrader | 30/457 |
| 1,789,248 | 1/1931 | Mobius | 30/454 |
| 2,642,044 | 6/1953 | Mussquiller | 30/452 |
| 2,708,905 | 5/1955 | Randall | D19/73 X |
| 3,809,137 | 5/1974 | Dombroski | 30/459 |
| 4,248,283 | 2/1981 | Kaye | 30/454 |

*Primary Examiner*—Douglas D. Watts
*Assistant Examiner*—Rinaldi Rada
*Attorney, Agent, or Firm*—Fitzpatrick, Cella, Harper & Scinto

[57] ABSTRACT

A sharpener for lead pencils, colored pencils, cosmetic pencils and the like with an essentially cuboid shaped sharpener housing, in which the longitudinal lateral sides of the sharpener housing are provided with complementary protrusions or recesses that allow fitting together of two sharpeners.

16 Claims, 2 Drawing Sheets

COSMETIC PENCIL SHARPENER

This application is a continuation of application Ser. No. 07/578,184 filed Sep. 6, 1990 now abandoned.

BACKGROUND OF THE INVENTION

1. Field of the Invention

The present invention relates to a sharpener for lead pencils, colored pencils, cosmetic pencils or the like, with an essentially cuboid sharpener housing.

2. Brief Description of the Prior Art

Sharpeners are known in various design shapes and sizes. Generally, the size of the sharpener, the inclination angle of the sharpening blades, and the size of the entry and outlet openings of the sharpener channel depend to a large degree on the pencils to be sharpened. Not only is the diameter of the pencil an important consideration, but different sharpeners are used with pencils of the same diameter if the pencils have leads having a different hardness. For example, a sharpener for a cosmetic pencil with a soft, smeary core must be designed differently from a sharpener for a pencil with a very hard lead core.

Double sharpeners for combined use in a particular field of application also are already known. These typically include single sharpeners having various sharpener channels for sharpening pencils of different thicknesses or, alternatively, for sharpening lead and colored pencils. However, these multi-sharpeners are limited to a particular combination from the start, making it impossible for a user to obtain and use a common structural component in the form of a multi-sharpener that has two or more particular single sharpeners.

SUMMARY OF THE INVENTION

To avoid these difficulties, a sharpener in accordance with the present invention has the longitudinal lateral walls of the sharpener housing provided with complementary protrusions or recesses, which provides means for fitting two sharpeners together.

Because of the design of the sharpener housing according to the present invention, a plurality of otherwise quite different sharpeners variously can be combined into one component unit. Particularly advantageously, the design of the longitudinal lateral walls is such that the protrusions or recesses of different sharpeners as a group are formed differently in such a way that only complementary sharpeners can be combined with each other. In other words, cosmetic pencil sharpeners for different types of lipsticks, eyebrow pencils or other cosmetic pencils, for example, will have associated profiles of the longitudinal lateral walls, but sharpeners for lead or colored pencils will have a different profile, so that only the sharpeners for associated groups of pencils can be combined into component units. In this connection it may also be practical to make the design such that only sharpeners for eyebrow pencils, for example, can be combined, so as to combine a plurality of pencils of different colors with each other. Sharpeners for pencils for eye shadow, fingernails, lips and the like then may be designed differently, so that only they can be combined with each other.

The profiling of the longitudinal lateral walls may be in the form of longitudinal or cross ribs, the shape and thickness of which in each case corresponding to the shape and thickness of the intermediate grooves on the opposite side. In this manner, two sharpeners will be held clampingly against one another, when fitted together.

In a preferred embodiment, the ribs furthermore may have a trapezoidal cross section which widens toward the outside, so that fitting together takes place either by overcoming a corresponding deformation force of the trapezoidal ribs or, preferably, by parallel displacement in the direction of the longitudinal axes of the ribs. In that event, it is more difficult to pull the two parts apart. In this connection it also may be advantageous to provide a conical form to the ribs and intermediate grooves, so that in the course of fitting the parts together, as mentioned above, the parts become wedged in the fitting direction. The parts thus will form a comparatively solid component unit that cannot easily be separated again.

It also is within the scope of the invention to provide knobs or buttons on one longitudinal, lateral wall and receiver sleeves on the other longitudinal, lateral wall. Likewise, it also is possible to design the opposing longitudinal lateral walls of a sharpener analogously to the design of interlocking toy blocks.

In order that the advantages of the present invention, through combining a plurality of sharpeners, also can be exploited with sharpeners that include catcher boxes for shavings, a further feature of the invention provides narrowed shavings catchers. Such catchers will not hinder the fitting together of two sharpeners, and can be mounted clampingly on each one of the sharpeners. A catcher design preferably is such that the longitudinal walls of the shavings catcher are mounted on the top of the sharpener. Further, the shavings catchers, may be provided with extended walls, to overlap the walls of the entry and outlet openings of the sharpener in a partially clamping and locking manner.

Further advantages, characteristics and details of the invention will become apparent from the ensuing description of various exemplary embodiments in conjunction with the drawings.

DETAILED DESCRIPTION OF THE PREFERRED EMBODIMENTS

Figure 1:
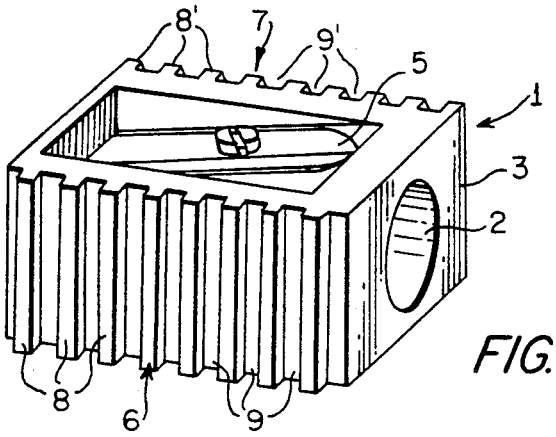
FIG. 1 is a perspective view of a first exemplary embodiment of a sharpener in accordance with the invention, having profiled longitudinal lateral walls.
Figure 2:
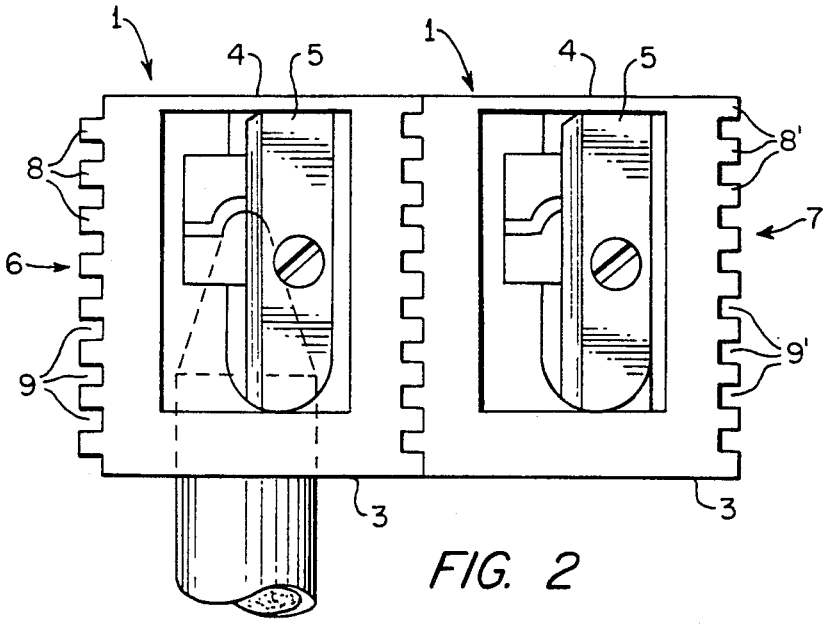
FIG. 2 is a top view of an arrangement of two sharpeners in accordance with FIG. 1, fitted together.

The sharpener shown in FIGS. 1 and 2 comprises a conventional cuboid sharpener housing 1 with a sharpener channel 2, the entry openings of which are disposed in one front wall 3 of the housing and the outlet opening is disposed in the rear wall 4, which is opposite the front wall, 2. The cone-shaped flank of the sharpener channel is disposed at a tangent to the blade of a sharpener knife 5.

In accordance with the present invention, the longitudinal lateral walls 6, 7 are provided with complementary cross ribs 8 and intermediate grooves 9, and cross ribs 8' and intermediate grooves 9', respectively, so that—as shown in FIG. 2—two sharpeners can be fitted together in a laterally clamped manner and thus form a component unit. Of course, a component unit also may be formed from three or more sharpeners. In the preferred embodiment the sharpeners are of the same type, for example, to sharpen pencils of different diameters; to sharpen different size cosmetic pencils; or to sharpen cosmetic pencils of different colors.

Figure 3:
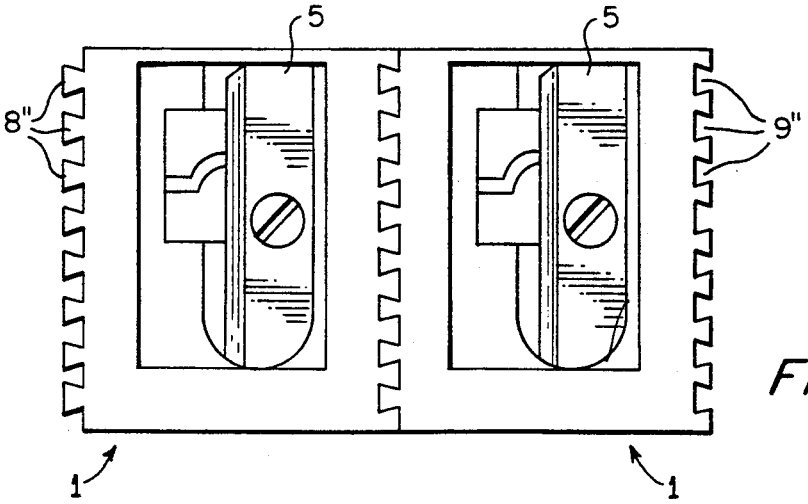
FIG. 3 is a top view of an arrangement of two sharpeners with trapezoidal cross ribs.

For a more solid connection, and to prevent the sharpener from being easily pulled apart, the ribs 8'' and complementary grooves 9'' may have a trapezoidal cross section, widening towards the exterior, as shown in FIG. 3.

Figure 4:
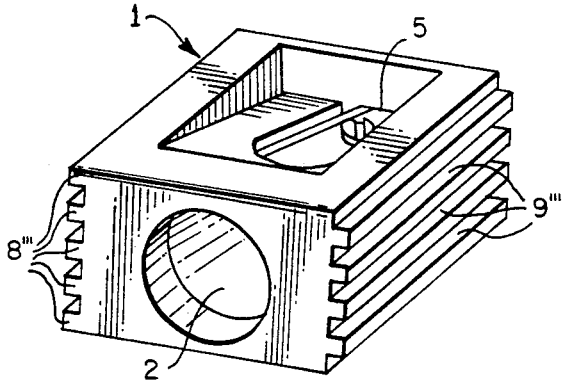
FIG. 4 is a perspective view of an embodiment of a sharpener with longitudinal ribs for combining a plurality of sharpeners into component units.
Figure 5:
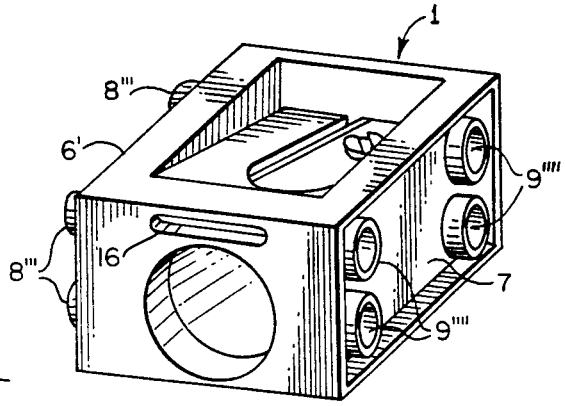
FIG. 5 is a further embodiment of a sharpener in accordance with the invention with knobs or receiver sleeves on the longitudinal lateral walls.

In place of the cross ribs shown in FIGS. 1 to 3, longitudinal ribs 8''' and longitudinal grooves 9''' extending longitudinally of the sharpener channel 2 may be provided, as shown in FIG. 4. Instead of forming ribs, knobs 8'''' for engaging with corresponding sleeves 9'''' which complement knobs 8'', may be provided, as shown in FIG. 5.

Figure 6:
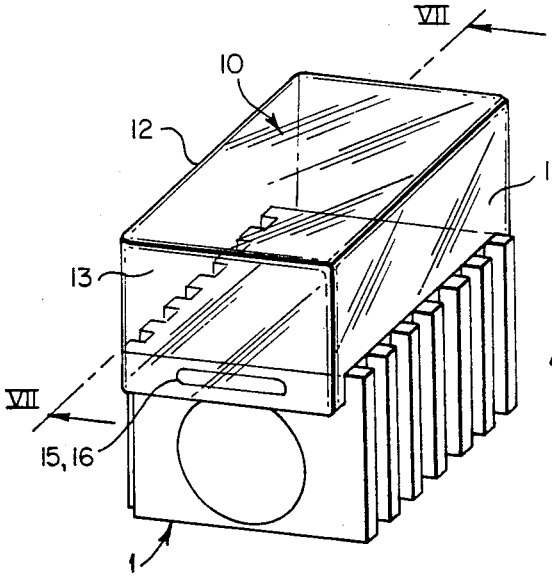
FIG. 6 is a perspective view of a sharpener in accordance with FIGS. 1 and 2 with a shavings catcher mounted thereon.
Figure 7:
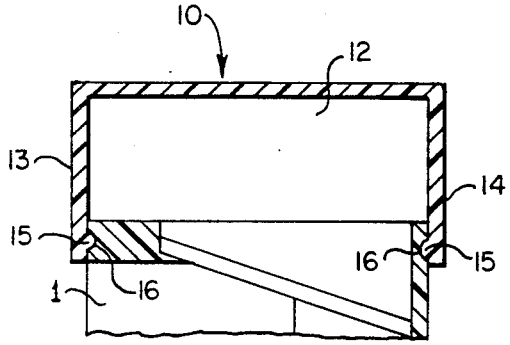
FIG. 7 is a longitudinal section along the line VII—VII of FIG. 6.

To make a sharpener according to the present invention into a sharpener with a shavings catcher, the exemplary embodiments of FIGS. 6 and 7 are provided with a shavings catcher box 10, that has been narrowed in respect to the sharpener housing in such a way that its longitudinal lateral walls 11 and 12 rest on the top of the sharpener and permit the ribs to fully protrude laterally. In this way, the shavings catcher box 10 does not hinder a fitting together of two sharpeners. Walls 13 and 14 of the shavings catcher box 10 also extend downward and are provided with retaining beads 15, which engage in a clamping and locking manner respective corresponding locking recesses 16 of the walls of the sharpener entry and outlet channels.

The present invention is not limited to the exemplary embodiments shown. In addition to the possibility of designing the locking protrusions similarly to commercially available interlocking toy blocks, another option, in connection with the design of longitudinal or cross ribs, is to provide a longitudinal conicity to the ribs and grooves. In that manner, when the sharpeners are fitted together, an increased clamped locking in the direction of fit is attained. In connection with the trapezoidal design according to FIG. 3, this conicity further prevents separation, in any direction, of a plurality of joined sharpeners, so that unintentional separation no longer can occur.

The description of the preferred embodiments, in accordance with the present invention as essentially pertaining to cuboidal shaped sharpener housings naturally includes slanted cuboids, and the like. For example, one usual wedge-shaped sharpener, into which a pencil is inserted, has top and bottom surfaces inclined towards each other, to enable inserting the sharpener with tension into a loop of a student pen case. A slanted cuboid, or the like has nothing to do with the fact that two longitudinal lateral walls may be laid out parallel to each other, for purposes of the invention.

Additionally, while holding loops are mentioned in the previous paragraph, and essentially require wedge-shaped sharpener housings, a sharpener design in accordance with the invention also is advantageous for another type of mounting in students pen cases. If an appropriate plate or rail equipped with matching protrusions or recesses is provided in the students' pen case, then the sharpeners can be easily slipped onto this plate or rail, and held fixedly, or with loops, very easily and securely. Rigidly or detachably retaining the plate or rail in in the pen case with glue, or by means of loops, is a simpler way to provide retention than by means of a loop that fits over the sharpener. A loop will stretch over time and its retention effect thus will be lost.

Finally, the profiling of the lateral walls of the sharpener in accordance with the invention is also easily suited for retaining such a sharpener in other receptacles. More particularly, profiles may be provided in boxes, so that box-type sharpeners with different shavings catchers can be very simply equipped with the associated sharpeners. All that is needed is a counterpart surface on the inside of the box onto which the desired sharpener is attached. In that even a sharpener, of course, must come to rest with its sharpener opening exactly under the corresponding insertion opening of the box, which for example may be in the box lid.

While preferred embodiments of the invention have been shown and described, the invention is to be limited solely by the scope of the appended claims.

I claim:

1. A sharpener system for pencils having a core, said system comprising two or more component sharpeners, each component sharpener comprising a separate housing having top and bottom walls and a fitting means that is disposed on at least one side of each housing, and a complementary fitting means that is disposed on a side of each housing that is opposite to the side having said fitting means, said fitting means and said complementary fitting means for interconnecting with each other, said top and bottom walls and the two sides defining a pencil channel, wherein two or more component sharpeners are selectively attachable by engaging the respective fitting means and complementary fitting means on the sides of each separate housing.

2. A sharpener system according to claim 1, wherein said fitting means and complementary fitting means comprise interlocking protrusions and recesses.

3. A sharpener system according to claim 1, wherein a first group of component sharpeners has first fitting means and first complementary fitting means compatible with said first fitting means, and a second group of component sharpeners has second fitting means and second complementary fitting means, compatible with said second fitting means, and wherein said first and second fitting means and complementary fitting means are not compatible.

4. In combination, at least two sharpeners for use with pencils that encase a core, each sharpener comprising an essentially cuboid sharpener housing having a front wall with a pencil entry opening, a rear wall with an outlet, top and bottom walls and a pair of longitudinal lateral walls (6, 7) which define a pair of side walls for the sharpener housing (1), said top and bottom walls and said side walls defining a pencil channel, wherein said side walls are provided with complementary protrusion and recess means which enable interconnecting said side wall for one sharpener housing with at least one side wall of a sharpener housing of another sharpener, characterized in that said pair of longitudinal lateral walls (6, 7) are provided with said protrusion and recess means comprising longitudinal or cross ribs and intermediate grooves, wherein the shape and thickness of respective longitudinal or cross ribs (8, 8', 8'', 8''') on one side wall corresponds to the shape and thickness of respective intermediate grooves (9, 9', 9'', 9''') on the opposite side wall.

5. A combination of sharpeners in accordance with claim 4, characterized in that the ribs (8'') have a trapezoidal cross section, that widens toward an exterior of said one side wall.

6. A combination of sharpeners in accordance with claim 4, characterized by a shavings catcher (10), with a lateral dimension less than a lateral dimension between the side walls of said housing of one of said sharpeners, so as not to hinder a fitting together of two sharpener housings, said catcher also having means for a clamp mounting on said housing of the one of said sharpeners (1).

7. A combination of sharpeners in accordance with claim 6, characterized in that the shavings catcher (10) is provided with extended front and rear walls (13, 14) that partially overlap the pencil entry opening and rear wall outlet and engage the sharpener housing front and rear walls, in a clamping and locking manner.

8. In combination, at least two sharpeners for use with pencils that encase a core, each sharpener comprising an essentially cuboid sharpener housing having a front wall with a pencil entry opening, a rear wall with an outlet, top and bottom walls and a pair of longitudinal lateral walls (6, 7) which define a pair of side walls for the sharpener housing (1), said top and bottom walls and said side walls defining a pencil channel, wherein said side walls are provided with complementary protrusion and recess means which enable interconnecting said side wall for one sharpener housing with at least one side wall of a sharpener housing of another sharpener, characterized by said protrusion and recess means comprising knobs (8'''') provided on one of said side walls (6), and receiving sleeves (9'''') provided on another of said side walls (7).

9. In combination, at least two sharpeners for pencils which encase a core, each sharpener comprising:

a housing comprising laterally opposed side walls and top and bottom walls, said side walls and top and bottom walls defining a pencil channel; and a fitting means disposed on at least one side wall of said housing that is capable of mating with a complementary fitting means that is disposed on at least one side wall of another sharpener housing, said fitting means and said complementary fitting means for interconnecting said housing and said another sharpener housing;

wherein each sharpener housing is substantially cuboidal and said fitting means comprises at least one of longitudinally extending ribs and grooves.

10. A combination of sharpeners according to claim 9, wherein said ribs and grooves have a trapezoidal cross-section.

11. A combination of sharpeners according to claim 9, further comprising a complementary fitting means that is on a side wall of each housing that is opposite to the side provided with said fitting means, wherein at least two sharpeners may be interconnected to form a common component unit.

12. A combination of sharpeners according to claim 9, further comprising a shavings catcher that is removably mounted on each housing and has side walls and a lateral dimension therebetween that is less than a lateral dimension of each housing which extends from the side of each housing on which the fitting means is disposed.

13. A combination of sharpeners according to claim 12, wherein said shavings catcher further comprises a front wall and a rear wall that respectively overlaps a portion of, and clamps in a locking manner upon, a front wall and a rear wall of said housing.

14. In combination, at least two sharpeners for pencils which encase a core, each sharpener comprising:

a housing comprising laterally opposed side walls and top and bottom walls, said side walls and top and bottom walls defining a pencil channel; and a fitting means disposed on at least one side wall of said housing that is capable of mating with a complementary fitting means that is disposed on at least one side wall of another sharpener housing, said fitting means and said complementary fitting means for interconnecting said housing and said another sharpener housing;

wherein each sharpener housing is substantially cuboidal and said fitting means comprises at least one of laterally extending ribs and grooves.

15. A combination of sharpeners according to claim 14, wherein said ribs and grooves have a trapezoidal cross-section.

16. In combination, at least two sharpeners for pencils which encase a core, each sharpener comprising:

a housing comprising laterally opposed side walls and top and bottom walls, said side walls and top and bottom walls defining a pencil channel; and a fitting means disposed on at least one side wall of said housing that is capable of mating with a complementary fitting means that is disposed on at least one side wall of another sharpener housing, said fitting means and said complementary fitting means for interconnecting said housing and said another sharpener housing;

wherein said sharpener housing is substantially cuboidal and said fitting means comprises one or more protruding buttons and said complementary fitting means comprises one or more sleeves for receiving said buttons.

* * * * *